US010619970B2

(12) United States Patent
Gardner, Jr. et al.

(10) Patent No.: US 10,619,970 B2
(45) Date of Patent: Apr. 14, 2020

(54) MECHANICALLY-ACTUATED TRIGGER ASSEMBLY AND PNEUMATIC VALVE FOR PNEUMATIC GUN

(71) Applicant: GOG Paintball, S.A., Plaza Roble Escazu (CR)

(72) Inventors: William M. Gardner, Jr., Loyalhanna, PA (US); Hans Semelsberger, Loyalhanna, PA (US); Edward S. Telford, Loyalhanna, PA (US)

(73) Assignee: GOG Paintball, S.A., San José (CR)

( * ) Notice: Subject to any disclaimer, the term of this patent is extended or adjusted under 35 U.S.C. 154(b) by 0 days.

(21) Appl. No.: 16/236,911

(22) Filed: Dec. 31, 2018

(65) Prior Publication Data

US 2019/0257612 A1 Aug. 22, 2019

Related U.S. Application Data

(60) Provisional application No. 62/631,719, filed on Feb. 17, 2018.

(51) Int. Cl.
*F41B 11/72* (2013.01)
*F41B 11/723* (2013.01)

(52) U.S. Cl.
CPC ..... *F41B 11/723* (2013.01)

(58) Field of Classification Search
CPC ..... F41B 11/72; F41B 11/721; F41B 11/722; F41B 11/723; F41B 11/724
USPC ..... 124/71–77
See application file for complete search history.

(56) References Cited

U.S. PATENT DOCUMENTS

| | | | | |
|---|---|---|---|---|
| 5,343,850 | A * | 9/1994 | Steer | A63H 27/14 124/59 |
| 5,613,483 | A * | 3/1997 | Lukas | F41B 11/721 124/70 |
| 9,182,191 | B2 * | 11/2015 | Gardner, Jr. | F41B 11/721 |
| 9,360,269 | B2 * | 6/2016 | Gardner, Jr. | F41B 11/721 |
| 2003/0047175 | A1 * | 3/2003 | Farrell | F41A 11/06 124/76 |
| 2006/0169264 | A1 * | 8/2006 | Lai | F41B 11/62 124/71 |
| 2008/0272169 | A1 * | 11/2008 | Liang | B25C 1/043 227/130 |
| 2011/0017188 | A1 * | 1/2011 | Call | F41B 11/62 124/73 |

(Continued)

*Primary Examiner* — Jonathan C Weber
(74) *Attorney, Agent, or Firm* — Craig R. Rogers; Simple IP Law, P.C.

(57) ABSTRACT

A trigger assembly and mechanically-actuated pneumatic valve provide improved feel and performance for a pneumatic gun. The trigger assembly can include a trigger having a cam-shaped contact surface. A separate actuator can be arranged between the trigger and a valve actuator. The contact surface of the trigger contacts the actuator to cause a contact surface of the actuator to actuate the valve actuator. Roller bearing contact surfaces can be provided on one or both ends of the actuator to reduce friction between the contact surfaces. The valve actuator may control a face seal, pin valve, and plug member to control distribution of gas within the valve. The face seal and pin valve members can redundantly seal an exhaust port. The plug member can seal off an input port during a firing operation of the pneumatic gun to improve gas efficiency.

10 Claims, 8 Drawing Sheets

(56) References Cited

U.S. PATENT DOCUMENTS

| | | | | |
|---|---|---|---|---|
| 2011/0232618 | A1* | 9/2011 | Gabrel | F41B 11/723<br>124/73 |
| 2014/0096758 | A1* | 4/2014 | Gardner, Jr. | F41B 11/721<br>124/73 |
| 2015/0020787 | A1* | 1/2015 | Tseng | F41B 11/00<br>124/73 |
| 2016/0040955 | A1* | 2/2016 | Gardner, Jr. | F41B 11/721<br>124/73 |

* cited by examiner

MECHANICALLY-ACTUATED TRIGGER ASSEMBLY AND PNEUMATIC VALVE FOR PNEUMATIC GUN

PRIORITY CLAIM

This application is a non-provisional of, and claims priority from, U.S. Provisional Patent Application Ser. No. 62/631,719, filed Feb. 17, 2018, the contents of which are hereby incorporated by reference in their entirety.

BACKGROUND OF THE INVENTION

Field of the Invention

This invention relates generally to pneumatic guns. More particularly, this invention relates to components and features of a mechanically-operated pneumatic gun that provide a number of advancements over the prior art.

Related Art

Electronically-operated pneumatic guns have become ubiquitous in tournament and recreational paintball game play and have also found applications in other fields and industries. For instance, electro-pneumatic guns can be used as remote delivery applicators for veterinary medicines, pesticides, insecticides, etc. In paintball particularly, electronically-operated spool-valve designs are extremely popular among players because of their relatively light weight, reliability, low-pressure operation, and ease of maintenance. One such electronically-operated paintball gun is shown and described in U.S. Pat. No. 7,617,820 ("the '820 patent"), the contents of which are hereby incorporated by reference in their entirety.

More recently, mechanical guns are becoming popular again because their slower fire rates make gameplay more appealing to larger numbers of participants, and because of their perceived improved durability and reliability. Unfortunately, however, mechanically-operated pneumatic guns have traditionally suffered from poorer trigger feel and responsiveness, as well as less-efficient valve operation. Some improved mechanically-operated pneumatic guns are shown and described in U.S. Pat. No. 9,182,191 ("the '191 patent") and U.S. Pat. No. 9,360,269 ("the '269 patent"), the contents of each of which are hereby incorporated by reference in their entirety.

SUMMARY OF THE INVENTION

According to various embodiments and principles of the present invention, a pneumatic gun can provide numerous improvements over the prior art, including, for instance, a mechanically-operated trigger assembly and a valve assembly (such as a pilot valve) with improvements to both the trigger feel and operation as well as to the operation and efficiency of the mechanical valve assembly.

According to one aspect of the present invention, a mechanically-operated trigger assembly is provided for a pneumatic gun. The trigger assembly may include a trigger, an actuator, and a return mechanism. A bearing assembly preferably provides a pivot point for the actuator, with still another bearing assembly providing a pivot point for the trigger. The actuator also preferably includes roller bearing contact surfaces for contacting both the trigger and the valve.

More particularly, a back profile of the trigger can provide a contact surface for contacting the actuator. The trigger contact surface preferably has an angled surface which acts like a cam as it applies force to the actuator (or lever arm). The cam action multiplies the force applied to the actuator by the trigger and thereby significantly reduces the required trigger pull force needed to actuate the valve assembly to fire the gun. This provides a significant advantage by allowing the player to more easily achieve consistent rates of fire, and by reducing the movement of the gun during the trigger pull and thereby improving accuracy.

The cam-shaped trigger contact surface preferably contacts a first roller bearing contact surface of the actuator to pivot the actuator and cause a second roller bearing contact surface of the actuator to contact a valve actuator to initiate a firing operation of the pneumatic gun. The roller bearing contact surfaces reduce friction, improve the feel and operation of the trigger assembly, and ensure that forces are applied in the appropriate directions. By including a separate actuator, rather than permitting the trigger contact surface to contact the valve actuator directly, the trigger and valve assemblies can be positioned in their most ideal locations in the gun assembly. This further allows greater design freedom in the arrangement of pneumatic gun, including the grip frame and its components.

The design and arrangement of the actuator preferably permits the actuator to transfer the multiplied force from the cam-shaped trigger contact surface to the valve actuator of the valve assembly in a straight, pushing direction. The straight, pushing force on the valve actuator helps eliminate unwanted friction and corresponding wear and tear on the valve assembly components. This design therefore enhances both the performance and the reliability of the valve assembly by improving durability and minimizing the force required to actuate the valve mechanisms. The actuator itself can include a lever arm that pivots about a pivot point provided by a bearing assembly arranged at a center of the lever arm. Alternatively, the pivot point can be off-set from a center position to adjust a force ratio between the force applied by the actuator lever arm to the valve actuator and that applied by the trigger to the actuator.

The return mechanism for the actuator can comprise, for instance, one or more springs or one or more magnets arranged to cause the actuator to pivot back to its ready position after each trigger pull. For instance, the return mechanism can be a spring assembly configured to pull the actuator from the actuating position back to a ready position. Alternatively, or additionally, reverse polarity magnets can be used to apply a force that encourages the actuator to rotate from the firing position back to the ready position.

According to another aspect of the present inventive concepts, an improved mechanically-actuated pneumatic valve can comprise an input port receiving compressed gas from a compressed gas regulator, and one or more output ports. An actuating mechanism can include both a face seal member and a pin valve member. The face seal and pin valve members can be arranged in the valve body and configured to move between at least two positions. In a first position, the face seal and pin valve members can permit compressed gas from the input port to be supplied to a first output port through a valve chamber while preventing compressed gas from escaping through a second output port. In a second position, the face seal and pin valve members can allow compressed gas from the first output port and valve chamber to pass through the second output port and vent to atmosphere, for instance, through one or more exhaust ports.

A plug member can further be provided to permit compressed gas from the input port to enter the valve chamber when the plug is in a first position, and to cut off the supply of compressed gas from the input port into the valve chamber when the plug is in a second position. The plug is preferably arranged in the second position before the valve chamber is vented to atmosphere.

A valve actuator, such as a pin or substantially pin-shaped valve actuator, for example, can be configured and arranged to move the face seal, pin valve, and plug members from their first positions to their second positions during actuation of the valve, such as during a trigger pull. The face seal, pin valve, and plug members may, for instance, be integrally formed on the valve actuator.

A chamber insert can also be included to secure a sealing member in place in the input port. In the second position, the plug can seal against the sealing member to prevent the input port from supplying compressed gas into the valve chamber. According to one aspect, the chamber insert may be configured to fit within the valve chamber in the valve body. The chamber insert may further include its own internal chamber and ports for receiving compressed gas from the input port and supplying the compressed gas to the respective output ports.

In one pneumatic gun embodiment, compressed gas having a selected pressure can be supplied from the compressed gas regulator to a compressed gas storage chamber of the pneumatic gun. The pneumatic valve can be configured to supply compressed gas of the selected pressure from the compressed gas regulator to a first surface of a spool-valve piston through the first output port when the face seal and pin valve members are arranged in their first, deactuated positions. The compressed gas acting on the first surface of the spool-valve piston can overcome a pneumatic or spring force acting on a second surface of the spool-valve piston.

In one embodiment, the spool-valve piston can comprise a bolt and a firing valve. The first surface can be a forward surface and the pneumatic force acting on the first surface can hold the bolt in a rearward position against a pneumatic force from the compressed gas storage chamber acting on the second piston surface area.

In one embodiment, a trigger assembly can be configured with an actuator having a contact surface arranged to contact a valve actuating mechanism (or "valve actuator") of the pneumatic valve. The actuator contact surface can, for example, be a roller bearing contact surface.

When the trigger is pulled, the trigger contact surface contacts a first roller bearing contact surface of the actuator to pivot a second roller bearing contact surface of the actuator into contact with the valve actuator. During actuation, the valve actuator causes the face seal, pin valve, and valve plug members to move from their first positions towards their second positions. As soon as the valve actuator begins to move, the face seal lifts from the outside surface of a corresponding sealing member (such as an o-ring) and no longer provides any sealing effect during that firing cycle. The pin valve member, however, preferably continues to seal the second output port until after the valve plug member moves into position in the input port and seals off the incoming air. After the valve plug member seals the input port, the pin valve member opens the second output port to vent the air from the valve chamber and connected first output port through the second output port and, if a separate exhaust port is provided, the one or more exhaust port(s).

Accordingly, in their second positions, the valve plug member preferably prevents compressed gas from being supplied into the valve through the input port, and gas from the first output port and valve chamber is preferably vented through the second output port past the face seal and pin valve members to an exhaust port(s) in the valve body. This initiates a firing operation of the pneumatic gun.

In embodiments where the first output port communicates with the forward piston surface, during valve actuation, gas is vented from an area communicating with the forward piston surface and a force on the second, rearward piston surface then drives the bolt forward and opens the firing valve. The bolt is thereby positioned into its forward, firing position and compressed gas from the compressed gas storage chamber vents through the firing valve and through ports arranged in the bolt to launch a projectile from the gun.

In one embodiment, the valve actuator may be permitted to continue travel past its second, firing position (in which the valve plug seals the input port and the pin valve member exhausts the valve chamber and connected first exhaust port) to a third position. In the third position, the valve plug continues to plug the input port and the pin valve member continues to exhaust gas from the valve chamber. Although the functions performed by the valve members may essentially be the same in the second and third positions, by permitting the valve actuator to continue travel past the initial point of firing, the start of the firing operation can begin more toward the middle of the trigger stroke, providing improved feel and performance.

In one embodiment, the face seal, pin valve, and valve plug members are integrally formed on a valve actuator. An upper portion of the valve actuator can provide a plug member that seals against an inside diameter of a first o-ring arranged in the input port of the valve to seal off incoming compressed gas from a compressed gas source. A chamber insert can be provided to hold the first o-ring in place in the input port. The upper portion of the valve actuator can also provide a top seal surface area for compressed gas from the compressed gas source to act on to force the valve actuator back to a ready position when the trigger is released. In an alternative embodiment, a surface area of the top seal can be increased to make the valve actuator more responsive to resetting the valve to its ready position. In a still further embodiment, a spring or other return mechanism can be provided to assist in moving the valve actuator back to a deactuated (or ready) position.

The face seal member is preferably arranged below the plug and is configured to seal against an outside surface of a second o-ring arranged at the second output port providing or leading to the exhaust port(s). The face seal member thereby helps prevent the release of compressed gas through the second output and exhaust port(s) when the valve is in its deactuated position. The face seal member further limits travel of the valve actuator and prevents the actuator from moving too far through the second output port. It should be recognized that, in some embodiments, the second output port can act as the exhaust port and separate exhaust ports are not required.

The pin valve member preferably comprises a pin having a first diameter configured to seal against an inside diameter of a second o-ring at the second output port (or, in an alternative embodiment, a third o-ring arranged at the exhaust port). The pin valve member further preferably comprises one or more reduced diameter sections configured to permit the release of compressed gas past the pin valve member when the reduced diameter section(s) are aligned with the respective second and/or third o-rings.

By using the plug, face seal, and pin valve members, several advantages can be obtained. First, the supply of compressed gas into the internal valve chamber can be cut off by the plug member before compressed gas is exhausted from the valve. This improves gas efficiency by preventing a state in which compressed gas from the gas source can travel directly to the exhaust port(s). Second, by utilizing the pin valve member, the timing of the firing sequence can be moved to later during the trigger stroke, as compared to a pure face seal configuration where the firing sequence happens almost immediately after the trigger contacts the valve actuator. Third, by permitting further travel of the valve actuator, past the initial point of firing, the firing operation can begin more towards the middle of a trigger stroke, further improving feel and operation. And fourth, by using a face seal member that contacts an outside surface of a sealing o-ring and a pin valve member that contacts the inside diameter of the sealing o-ring, a good, redundant seal can be provided without undue friction between the valve actuator and the sealing o-ring.

Various aspects, embodiments, and configurations of this invention are possible without departing from the principles disclosed herein. This invention is therefore not limited to any of the particular aspects, embodiments, or configurations described herein.

BRIEF DESCRIPTION OF DRAWINGS

The foregoing and additional objects, features, and advantages of the present invention will become more readily apparent from the following detailed description of preferred embodiments, including the following drawings, in which.

DETAILED DESCRIPTION OF ILLUSTRATIVE EMBODIMENTS

Figure 1:
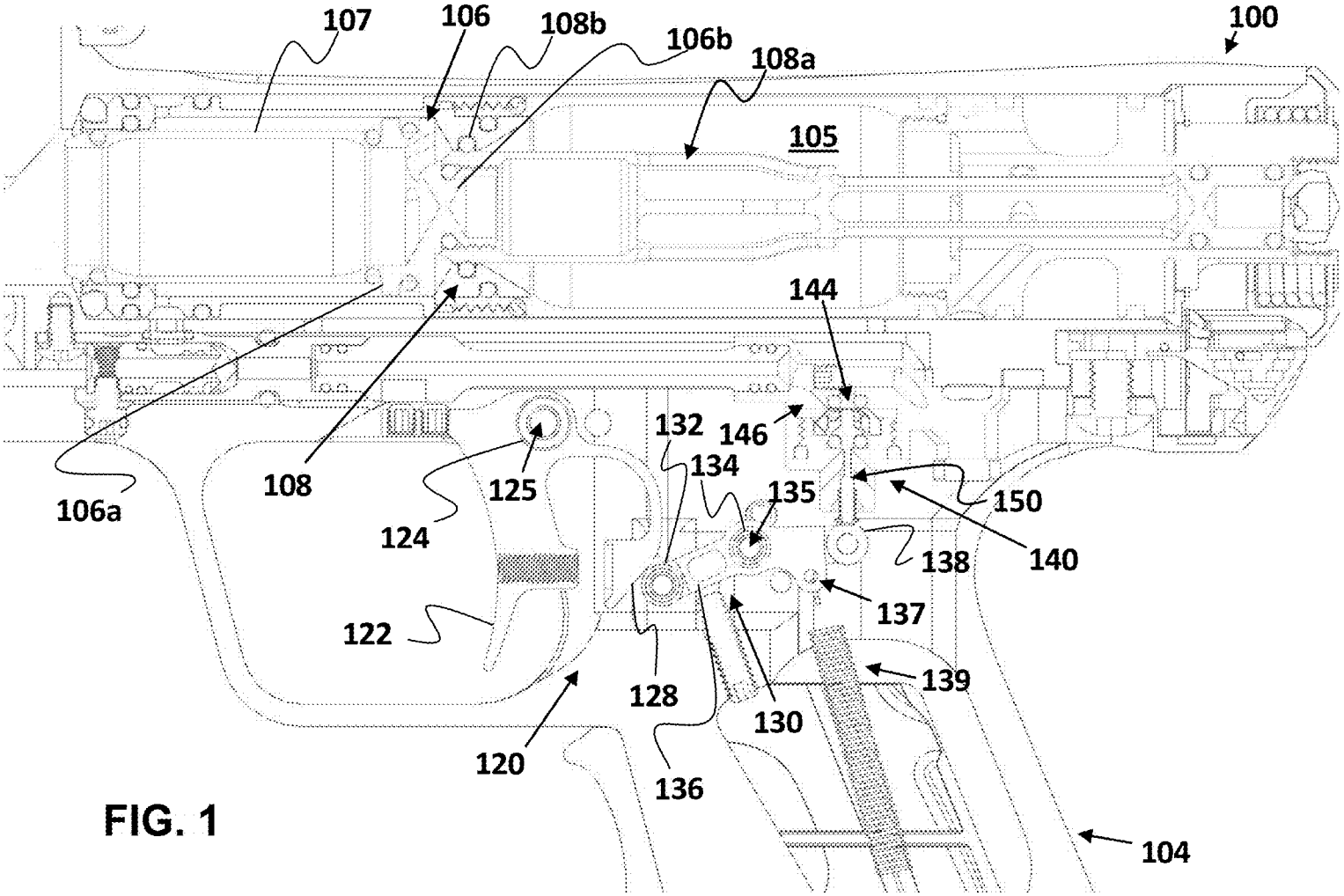
FIG. 1 is a somewhat schematic cross-sectional side view of a mechanical pneumatic gun showing a trigger, actuator, and valve assembly arranged in the pneumatic gun according to one embodiment incorporating principles of the present invention, with the gun components shown in a ready position.

Various features, benefits, and configurations incorporating the principles of the present inventive concepts in illustrative embodiments are shown in the accompanying drawings. Additional features, benefits and configurations will be readily apparent to those of ordinary skill in the art based on this disclosure, and all such features, benefits and configurations are considered within the scope of the present invention. Various illustrative embodiments will now be described in further detail in connection with the accompanying drawings.

Referring first to FIGS. 1-6, in one embodiment, a mechanically-operated pneumatic gun 100 can include an improved trigger assembly 120 and an improved valve assembly 140 which provide improvements to both trigger feel and operation as well as to the operation and efficiency of the valve assembly 140.

As illustrated, the pneumatic gun 100 can include a mechanically-operated trigger assembly 120. The trigger assembly 120 can include a trigger 122, an actuator 130, and an actuator return mechanism 139. A bearing assembly 124 preferably provides a pivot point 125 for the trigger 122, with still another bearing assembly 134 providing a pivot point 135 for the actuator 130. In this manner, both the trigger 122 and the actuator 130 are permitted to pivot about their pivot points 125, 135, respectively, with minimal friction.

In a preferred embodiment, a contact surface 128 of the trigger 122 preferably has an angled surface which acts like a cam as it applies force to the actuator 130 (comprising a lever arm 136). This cam action multiplies the force applied to the actuator 130 by the trigger 122 and thereby significantly reduces the required trigger pull force needed to actuate the valve assembly 140 to fire the gun 100. This provides a significant advantage by allowing the player to more easily achieve improved rates of fire, and by reducing the movement of the gun 100 during the trigger pull to thereby improve accuracy.

The cam-shaped trigger contact surface 128 preferably contacts a first roller bearing contact surface 132 of the actuator 130 to pivot the actuator arm 136 and cause a second roller bearing contact surface 138 of the actuator 130 to contact a valve actuator 150 to initiate a firing operation of the pneumatic gun 100. The roller bearing contact surfaces 132, 138 reduce friction and improve the feel and operation of the trigger assembly 120. By including a separate actuator 130, rather than permitting the trigger contact surface 128 to contact the valve actuator 150 directly, greater design freedom is provided with respect to the locations of the trigger 120 and valve assemblies 140, allowing them to be positioned in any preferred locations in the gun assembly 100.

The design and arrangement of the actuator 130 preferably permits the actuator arm 136 to transfer the multiplied force from the cam-shaped trigger contact surface 128 to the valve actuator 150 of the valve assembly 140 in a straight, pushing direction. The straight, pushing force on the valve actuator 150 helps eliminate unwanted friction and corresponding wear and tear on the valve assembly components. This design therefore enhances both the performance and the reliability of the valve assembly 140 by improving durability and minimizing the force required to actuate the valve mechanisms. The actuator 130, itself, can comprise a lever arm 136 that pivots about a pivot point 135 provided by a bearing assembly 134 arranged at a center of the lever arm 136. Alternatively, the pivot point 135 can be off-set from a center position to adjust a force ratio between the force applied by the lever 136 to the valve actuator 150 and that applied by the trigger 122 to the actuator 130.

Figure 3:
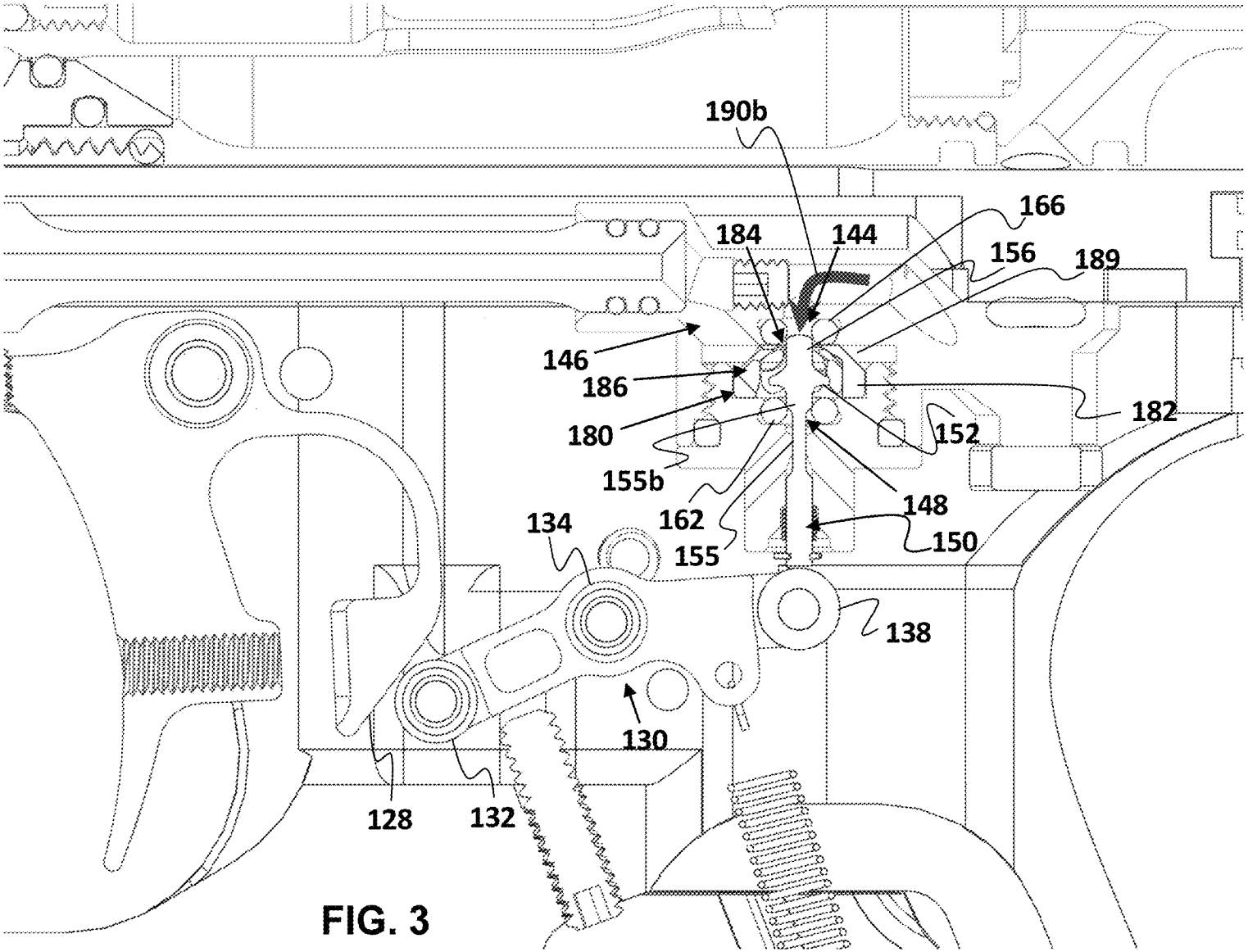
FIG. 3 is a somewhat schematic cross-sectional side view of the trigger and valve assemblies of FIG. 2, illustrating the valve assembly in a partially-actuated position, such as during initiation of a firing sequence.

As explained above, the actuator 130 also preferably includes roller bearing contact surfaces 132, 138 for contacting both the trigger 122 and an actuator 150 of the valve 140. More particularly, a contact surface 128 of the trigger 122 preferably contacts a first roller bearing contact surface 132 of the actuator 130 to cause the actuator arm 136 to pivot. As shown in FIG. 3, when the actuator arm 136 pivots, a second roller bearing contact surface 138 of the actuator 130 contacts a valve actuator 150 to initiate a firing operation of the pneumatic gun 100. The roller bearing contact surfaces 132, 138 of the actuator 130 reduce friction between the contact surfaces and improve the feel and operation of the trigger assembly 120. They also ensure that the trigger 122 and actuator 130 forces are applied in the desired directions.

An actuator return mechanism 139 is provided to return the actuator 130 to its ready position following a firing operation. The return mechanism 139 for the actuator 130 can comprise, for instance, one or more springs or one or more magnets arranged to cause the actuator 130 to pivot back after each trigger pull to its ready position. In this embodiment, for instance, the return mechanism 139 is a spring assembly connected between a connection point (not shown) on the grip frame 104 and a connection point 137 on the actuator. The spring 139 is configured to exert a return force on the actuator 130 to pull the actuator arm 136 from the actuating position back to a ready position. Alternatively, or additionally, reverse polarity magnets or other mechanisms (not shown) can be used to apply a force that encourages the actuator to rotate from the firing position back to the ready position. Of course, numerous variations to this specific embodiment are possible and are considered within the scope of the present invention.

As mentioned previously, electronically-operated pneumatic guns are commonplace in tournament and recreational paintball game play. One such electronically-operated paintball gun is shown and described in the '820 patent. The principles of the present invention provide, among other things, a mechanism for converting an electro-pneumatic paintball gun, such as that shown in the '820 patent, into a mechanically-operated pneumatic gun by replacing the electronic trigger and valve assembly with a mechanical trigger and valve assembly.

Referring still to FIGS. 1-6, according to certain embodiments of the present invention, a mechanically-operated trigger assembly 120 and a valve assembly 140 are provided for a mechanically-operated pneumatic gun 100. The trigger assembly 120 preferably includes a trigger 122, an actuator 130, and a return mechanism 139 arranged in a grip frame 104 of the pneumatic gun. The trigger 122 is preferably configured to cause the actuator 130 to pivot into contact with a valve actuator 150 for initiating a firing operation of the pneumatic gun 100 during trigger pull. A loading operation occurs when the trigger 122 is released.

Figure 2:
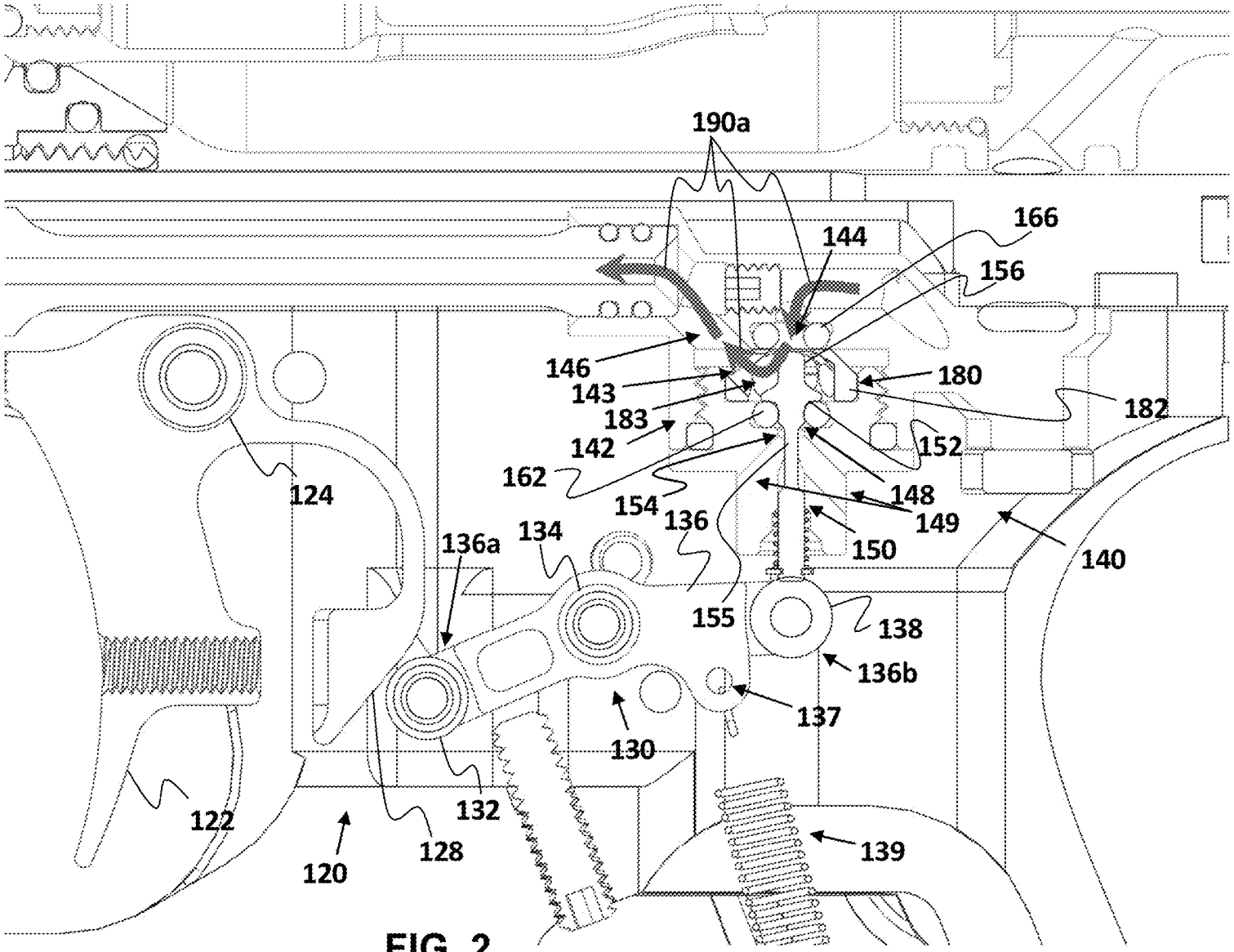
FIG. 2 is an enlarged cross-sectional side view showing the trigger and valve assemblies of the pneumatic gun of FIG. 1, with the valve assembly arranged in a deactuated position.

Referring specifically to FIG. 2, the trigger 122 can interact with the actuator 130, for instance, through a first roller bearing contact surface 132 arranged on a first end 136*a* of the actuator arm 136. The first roller bearing contact surface 132 is provided to reduce friction between the trigger 122 and the actuator 130 and to improve trigger performance and feel. A second roller bearing contact surface 138 of the actuator 130 can be located on an opposite end 136*b* of the actuator arm 136, and preferably contacts a valve actuator 150 of the valve assembly 140 to actuate the valve 140 and initiate the firing operation. The second roller bearing contact surface 138 is also provided to reduce friction and improve the feel and performance of the triggering mechanism 120, as well as to ensure that the actuating force on the valve actuator 150 is provided in a straight, vertical direction. Both the trigger 122 and the actuator 130 can further be configured with roller bearing pivot members 124, 134, respectively, to permit easy rotation of the trigger 122 and actuator 130 about their pivot points 125, 135, respectively, with minimal friction.

The return mechanism 139 can comprise, for instance, one or more springs and/or one or more magnets arranged to cause the actuator 130 to rotate back to its ready position after each trigger pull. For instance, the return mechanism 139 can be a spring assembly connected to the actuator arm 136 at a connection point 137 and configured to pull the actuator 130 back from the actuating position to a start or ready position. Alternatively, or additionally, reverse polarity magnets or other mechanisms can be used to apply a force that encourages the actuator 130 to pivot from the firing position back to the ready position. An actuator stop 137 may also be provided to limit the pivot motion of the actuator 130 by physically contacting the actuator arm 136 to stop further travel (see FIG. 4).

According to another aspect of the present inventive concepts, an improved mechanically-actuated pneumatic valve 140 can comprise an input port 144 receiving compressed gas from a compressed gas regulator (not shown) and one or more output ports 146, 148. These input 144 and output ports 146, 148 of the valve 140 may be similar to those of the conventional electro-pneumatic paintball gun described in the '820 patent and those of the mechanical valve assemblies described in the '191 and '269 patents.

Referring now to FIGS. 2-4 and FIG. 6, unlike the valves in the conventional electro-pneumatic paintball gun and previous mechanical gun designs, however, an actuating mechanism 150 of the valve 140 in the present embodiment can operate both a face seal member 152 and a pin valve member 154, and may further include a plug member 156. The face seal 152 and pin valve 154 members can be arranged in the valve body 142 and can be configured to move between at least two positions. In first (deactuated) positions (see FIG. 2), the face seal 152 and pin valve 154 members can permit compressed gas (represented by arrows 190*a*) from the input port 144 to be supplied to a first output port 146 while preventing compressed gas from escaping through a second output port 148. In second (actuated) positions (see FIG. 4), the face seal 152 and pin valve 154 members can allow compressed gas (represented by arrows 190*c*) from the valve body 142 to pass through the second output port 148 to vent to atmosphere either directly or through one or more additional exhaust ports 149.

Figure 4:
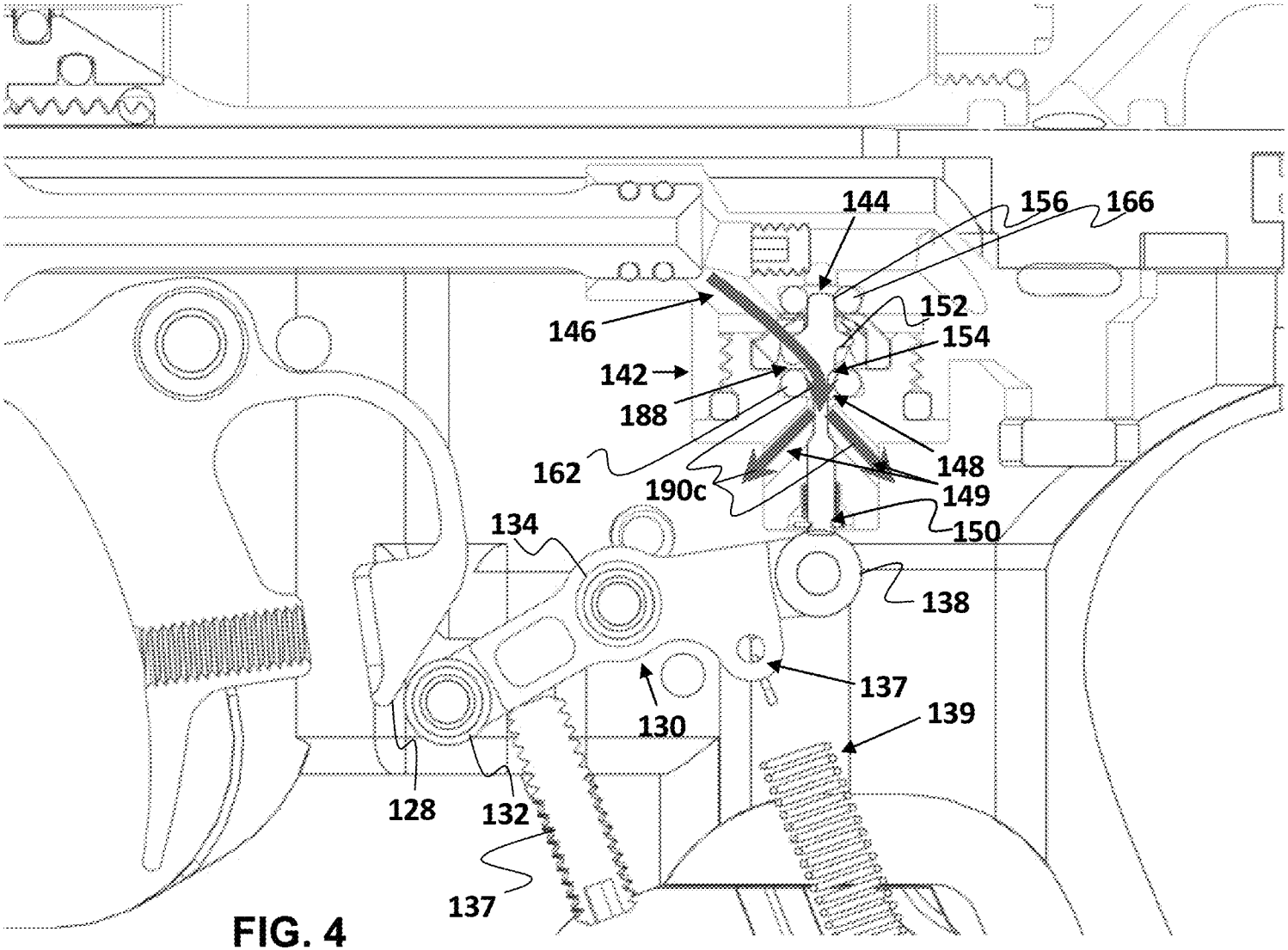
FIG. 4 is a somewhat schematic cross-sectional side view of the trigger and valve assemblies of FIGS. 2 and 3, illustrating the valve assembly in an actuated position.
Figure 5:
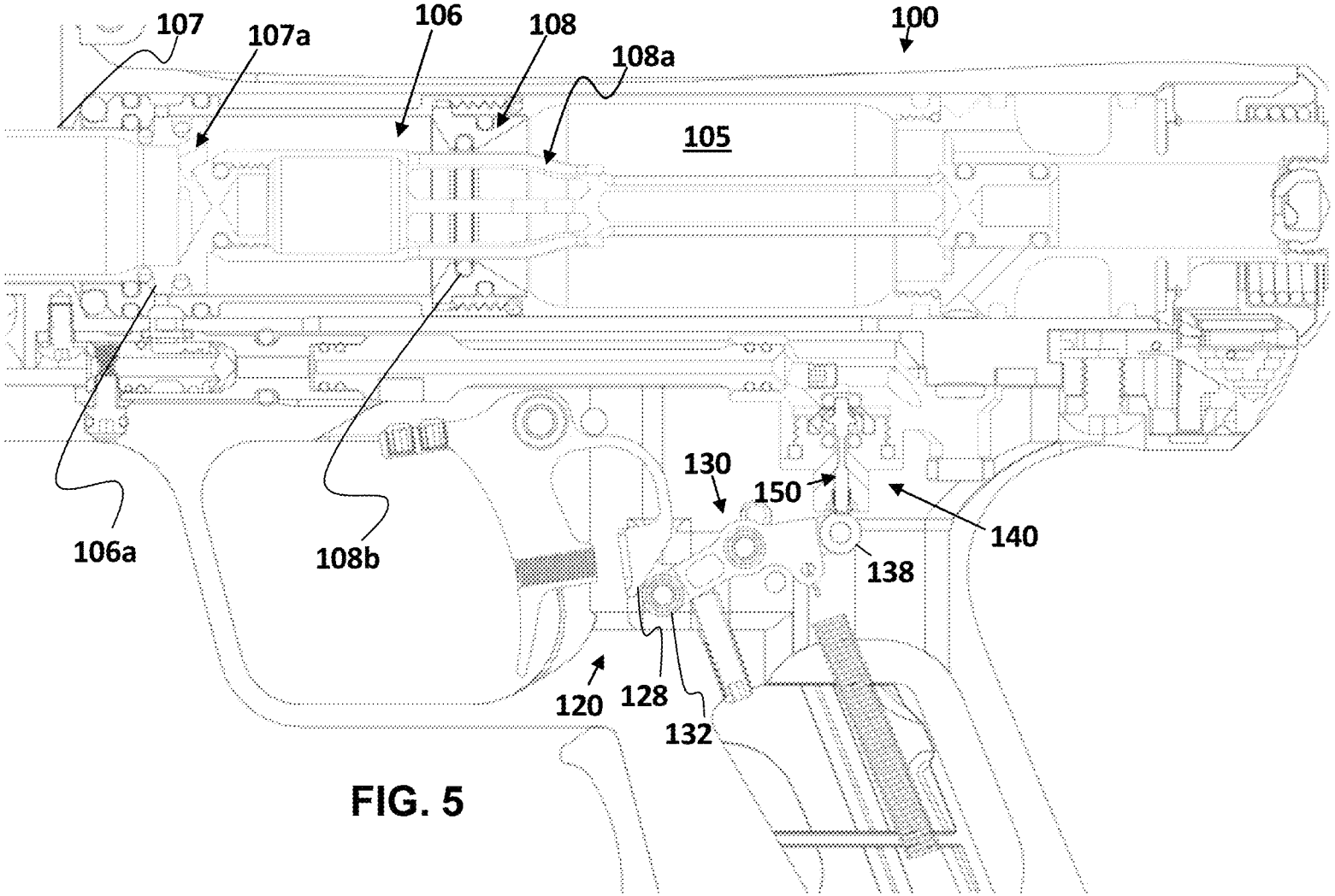
FIG. 5 is a somewhat schematic cross-sectional side view of the mechanically-actuated pneumatic gun of FIG. 1, illustrating the pneumatic gun components in the firing position.

The actuating mechanism 150 of the valve 140 can further operate a plug member 156 that, in a first position, permits compressed gas from the input port 144 to enter a valve chamber 143 (see FIG. 2) and, in a second position, cuts off the supply of compressed gas (represented by arrow 190*b*) from the input port 144 into the valve chamber 143 (see FIGS. 3 and 4). The plug member 156 can be arranged in its second position before and while the valve 140 is vented to atmosphere. A valve actuator 150, such as a pin or pin-shaped actuator, for example, can be configured and arranged to move the face seal 152, pin valve 154, and plug 156 members from their first positions to their second positions during actuation of the valve 140, such as during a trigger pull.

Figure 6:
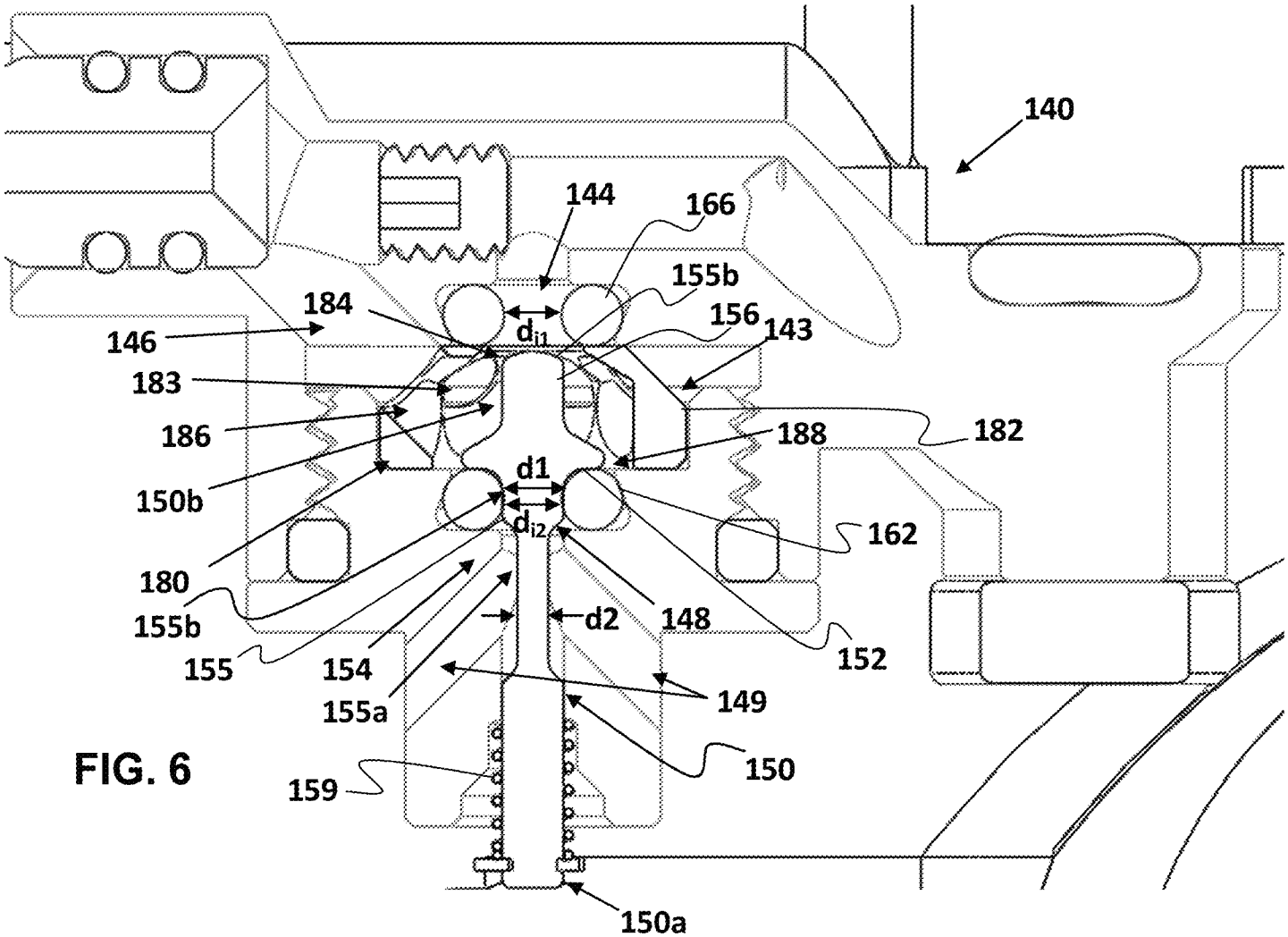
FIG. 6 is a somewhat schematic enlarged cross-sectional side view of the valve assembly of FIG. 2.

As shown in detail in FIG. 6, the face seal 152, pin valve 154, and valve plug 156 members may all be integrally formed on a valve actuator 150. An upper portion 150*b* of the valve actuator 150 can provide a plug member 156 that seals against an inside diameter $d_{i1}$ of a first o-ring 166 arranged in the input port 144 of the valve 140 to seal off incoming compressed gas from a compressed gas source. The upper portion 150*b* of the valve actuator 150 can also provide a top seal surface area 155*b* for compressed gas from the compressed gas source to act on to force the valve actuator 150 back to a ready (deactuated) position when the trigger 122 is released. In an alternative embodiment, a surface area of the top seal 155*b* can be increased to make the valve actuator 150 more responsive to resetting the valve 140 to its ready position. In the embodiment shown, a spring or other return mechanism 159 can also be provided to assist in moving the valve actuator 150 back to the ready position.

A chamber insert 180 can be included and arranged within the internal chamber 143 of the valve body 142. The chamber insert 180 can be configured to maintain the first o-ring 166 in its proper position in the input port 144. The chamber insert 180 can further include its own internal chamber 183 (to hold compressed gas) and ports 184, 186, 188 (to receive compressed gas from the input port 144 and direct it to the respective output ports 146, 148). An alignment pin (not shown) could be provided to properly align the chamber insert 180 within the internal valve chamber 143 by securing within mating alignment holes (not shown) in the chamber and valve bodies 182, 142, respectively.

The face seal member 152 is preferably arranged below the plug 156 and configured to seal against an outside surface of a second o-ring 162 arranged at the second output port 148 leading to the exhaust port(s) 149. The chamber insert 180 could further be configured to hold the second o-ring 162 in place in the second output port 148. The face seal member 152 helps prevent the release of compressed gas through the second output and exhaust ports 148, 149, respectively, when the valve 140 is in its deactuated position. The face seal 152 further limits travel of the valve actuator 150 and prevents the valve actuator 150 from moving too far through the second output port 148, and thereby helps to position the valve actuator 150 in its proper ready position.

Figure 8:
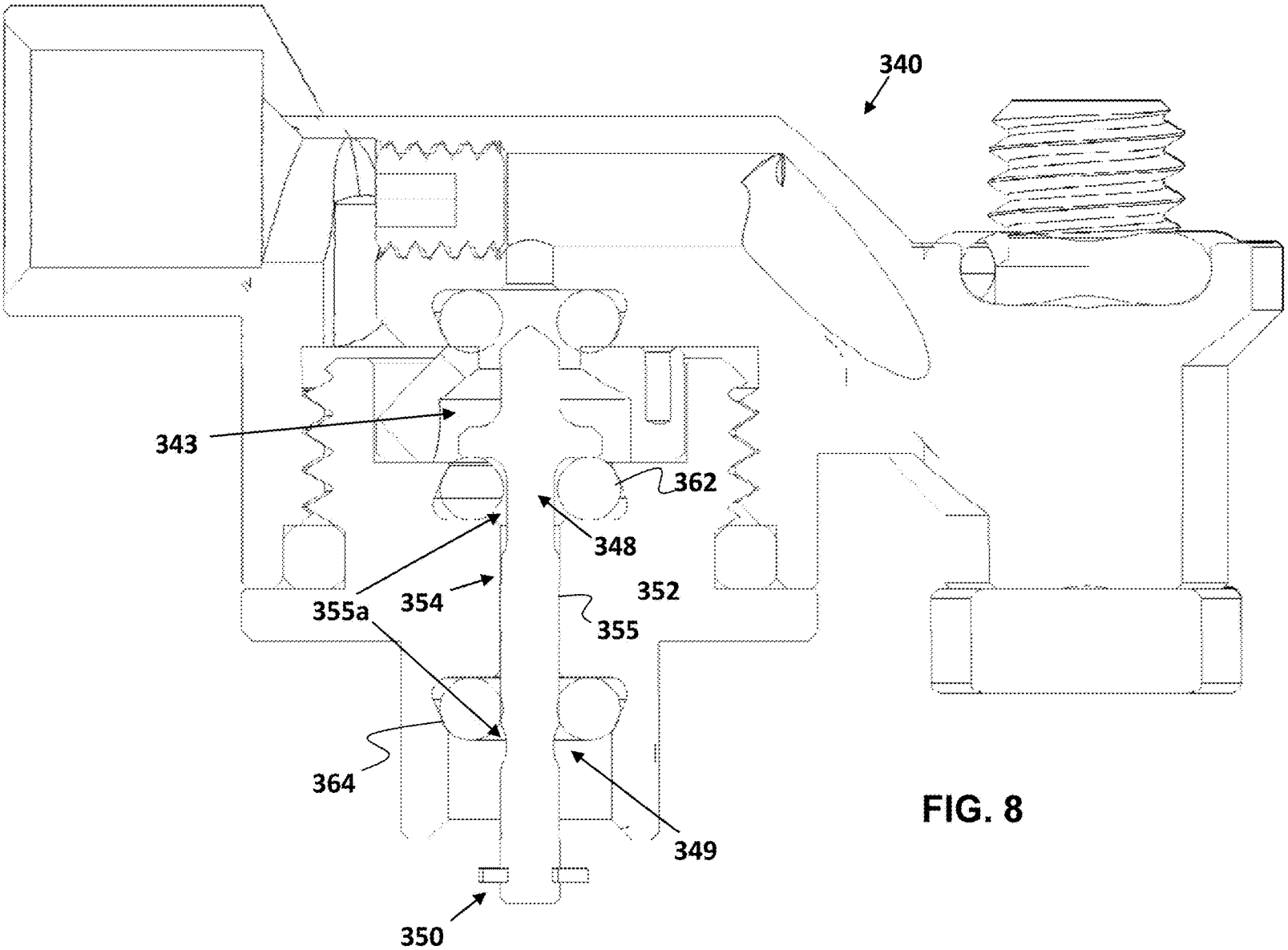
FIG. 8 is a somewhat schematic cross-sectional side view of a valve assembly according to a still further alternative embodiment.

The pin valve member 154 preferably comprises a pin 155 having a first diameter d1 configured to seal against an inside diameter $d_{r2}$ of the second o-ring 162 at the second output port 148 (or, in an alternative embodiment shown in FIG. 8, a third o-ring 364 arranged at the exhaust port 349). The pin valve member 154 further preferably comprises one or more reduced diameter sections 155*a*, having a second, smaller diameter d2 configured to permit the release of compressed gas past the pin valve member 154 when the reduced diameter section(s) 155*a* are aligned with the respective ones of the second and/or third o-rings 162, 364, respectively.

In one embodiment, the valve actuator 150 may be permitted to travel past its second, firing position to a third position. In both the second and third positions, the valve plug 156 seals the input port 144 and the pin valve member 154 exhausts the valve chamber 143 and connected first output port 146. Although the functions of the valve actuating members 152, 154, 156 are the same in the second and third positions, by permitting the valve actuator 150 to continue travel past the initial point of firing, the firing operation can begin more toward the middle of the trigger stroke, providing improved feel and performance.

As noted previously, by using a valve actuator 150 including plug 156, face seal 152, and pin valve 154 members, several advantages can be obtained. First, the supply of compressed gas into the internal valve chamber 143 can be cut off by the plug member 156 before compressed gas is exhausted from the valve 140. This improves gas efficiency by preventing a state in which compressed gas from the gas source can travel directly to atmosphere. Second, by utilizing the pin valve member 154, the timing of the firing sequence can be moved to later during the trigger stroke, as compared to a pure face seal configuration where the firing sequence happens almost immediately after the trigger contacts the valve actuator. Third, by permitting further travel of the valve actuator 150 past the initial point of firing, the firing operation can begin more towards the middle of a trigger stroke thereby further improving feel and operation. And fourth, by using a face seal member 152 that contacts an outside surface of a sealing o-ring 162 and a pin valve member 154 that contacts the inside surface of the sealing o-ring 162, a good, redundant seal can be provided without undue friction between the valve actuator 150 and the sealing o-ring 162.

Referring further to FIGS. 1-6, operation of the pneumatic gun 100 utilizing the improved trigger and valve assemblies 120, 140, respectively, will be explained. More specifically, in one pneumatic gun embodiment, compressed gas having a selected pressure can be supplied from the compressed gas regulator (not shown) to a compressed gas storage chamber 105 of the pneumatic gun 100. The pneumatic valve 140 can be configured to supply compressed gas of the selected pressure from the compressed gas regulator to a first surface 106*a* of a spool-valve piston 106 through the first output port 146 when the face seal 152 and pin valve 154 members are arranged in their first (deactuated) positions. The compressed gas from the pneumatic valve 140 acting on the first surface 106*a* of the spool-valve piston 106 can overcome a pneumatic or spring force acting on a second surface 106*b* of the spool-valve piston 106.

In this embodiment, the spool-valve piston 106 comprises a bolt 107 and firing valve ports 108*a*. The first surface 106*a* can be a forward surface and the pneumatic force acting on the first surface 106*a* can hold the bolt 107 in a rearward position against a pneumatic force from the compressed gas storage chamber 105 acting on the second piston surface area 106*b*.

The trigger assembly 120 is provided with an actuator 130 having a contact surface 138 arranged to contact a valve actuating mechanism (or "valve actuator") 150 of the pneumatic valve 140. The contact surfaces of the valve actuator and/or trigger can, for example, be a roller bearing contact surface 132, 138.

In this embodiment, when the trigger 122 is pulled, its contact surface 128 contacts a first roller bearing contact surface 132 of the actuator 130 to cause a second roller bearing contact surface 138 of the actuator 130 to pivot into contact with the valve actuator 150. During actuation, the valve actuator 150 causes the face seal 152, pin valve 154, and valve plug 156 members to move from their first positions towards their second (actuated) positions. In an intermediate position, as soon as the valve actuator 150 begins to move, the face seal 152 lifts from the outside surface of the corresponding o-ring 162 and no longer provides any sealing effect during this firing cycle (see FIG. 3). The wider part 155*b* of the pin 155 of pin valve member 154, however, continues to seal the second output port 148 in this intermediate position until after the valve plug member 156 moves into position in the input port 144 and seals off the incoming air (represented by arrow 190*b*). After the valve plug member 156 seals the input port 144, the narrow part 155*a* of the pin valve member 154 "opens" the second output port 148 (by aligning with the o-ring 162) to vent the air from the valve chamber 143 and connected first output port 146 through the second output port 148 and exhaust port(s) 149.

Accordingly, when the valve components are arranged in their second positions, the valve plug member 156 preferably prevents compressed gas from being supplied into the valve 140 through the input port 144, and gas from the first output port 146 and valve chamber 143 is preferably vented through the second output port 148 past the face seal 152 and pin valve members 154 to an exhaust port 149 in the valve body 142. This begins the firing operation of the pneumatic gun 100. Because the first output port 146 communicates with the forward piston surface 106*a*, during valve actuation, gas is vented from an area communicating with the forward piston surface 106*a* and a force on the second, rearward piston surface 106*b* then drives the bolt 107 forward and opens the firing valve 108 by aligning the firing valve ports 108*a* with the firing valve sealing member 108*b*. The bolt 107 is thereby positioned into its forward, firing position and compressed gas from the compressed gas storage chamber 105 vents through the firing valve 108 and through ports 107*a* arranged in the bolt 107 to launch a projectile from the gun 100.

Figure 7:
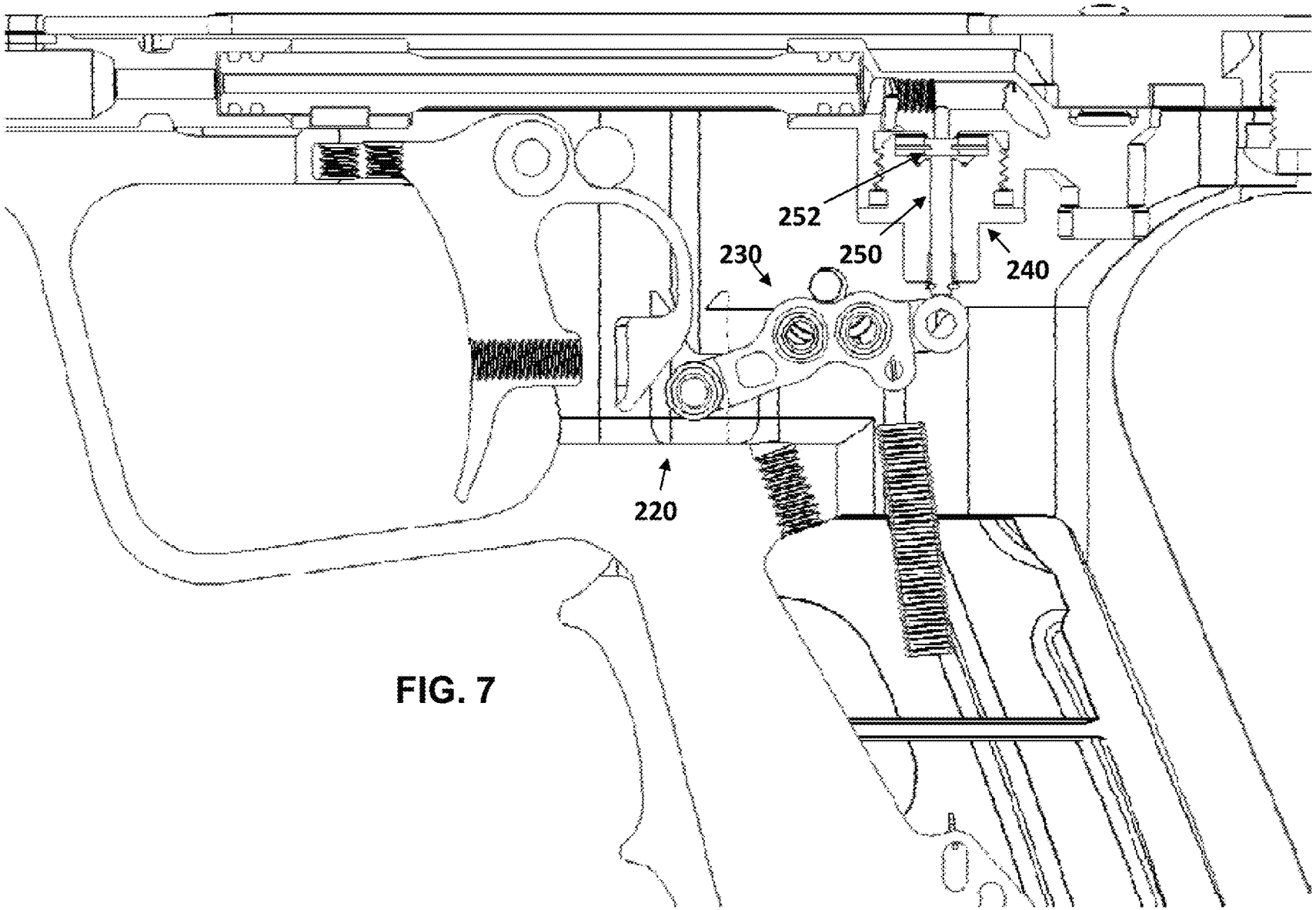
FIG. 7 is a somewhat schematic cross-sectional side view of a pneumatic gun having trigger and valve assemblies according to alternative embodiments.

FIGS. 7 and 8 depict alternative embodiments incorporating various aspects of the present inventive concepts. FIG. 7, for instance, depicts a valve 240 in which a valve actuator 250 comprises a face seal member 252 without a pin valve or plug member. FIG. 7 also illustrates an alternative configuration for the actuator 230 of the trigger assembly 220.

FIG. 8 depicts an alternative embodiment of a valve assembly 340, in which a lower portion 355 of the valve pin member 354 extends through second and third o-rings 362, 364, respectively, between the valve chamber 343 and the exhaust port 349. In this embodiment, the valve pin member 354 has a lower pin member 355 with multiple reduced diameter sections 355*a* that permit compressed gas from the valve chamber 343 to vent to atmosphere through the second output port 348 and exhaust port 349 past the second and third o-rings 362, 364, respectively, when the valve actuator 350 of the valve assembly 340 is in an actuated position.

Having described and illustrated principles of the present invention in various preferred embodiments thereof, it should be apparent that the invention can be modified in arrangement and detail without departing from such principles.

What is claimed is:

1. A trigger assembly and mechanical pneumatic valve for a pneumatic gun, comprising:

a trigger pivotably arranged in a pneumatic gun, said trigger having a contact surface;

an actuator pivotably arranged in the pneumatic gun, said actuator having a first end configured to be contacted by the contact surface of the trigger and a second end configured to contact a valve actuator to initiate a firing operation of the pneumatic gun in response to a trigger pull;

a valve body comprising a plurality of ports for communicating compressed gas, said plurality of ports comprising an input port, a first output port, and a second output port;

a first sealing member surrounding the input port and a second sealing member surrounding the second output port;

a face seal member configured to abut against an outside contact surface of the second sealing member and seal the second output port when the mechanical pneumatic valve is in a non-actuated state;

a pin valve member configured to seal against an inside contact surface of the second sealing member and provide a redundant seal of the second output port when the mechanical pneumatic valve is in the non-actuated state; and a plug member configured to seal against an inside surface of the first sealing member and close the input port when the mechanical pneumatic valve is in an actuated state, wherein the valve actuator is configured to move the face seal member, pin valve member, and plug member.

2. A trigger assembly and mechanical pneumatic valve according to claim 1, wherein the contact surface of the trigger comprises a cam-shaped surface to multiply a force exerted by the trigger on the actuator and reduce a force required to be exerted on the trigger to actuate the valve actuator.

3. A trigger assembly and mechanical pneumatic valve according to claim 1, wherein the actuator comprises a roller bearing contact surface arranged on a first end of the actuator to be contacted by the contact surface of the trigger.

4. A trigger assembly and mechanical pneumatic valve according to claim 1, wherein the actuator comprises a roller bearing contact surface arranged on a second end of the actuator to contact the valve actuator.

5. A trigger assembly and mechanical pneumatic valve according to claim 1, wherein the face seal, pin valve, and plug members are all integrally formed on the valve actuator, wherein the valve actuator is configured to move the face seal away from the second sealing member and to move the pin valve member to a position where a recessed area of the pin valve member aligns with the second sealing member to exhaust compressed gas through the second output port, and wherein the valve actuator is further configured to move the plug member into a sealing position within the first sealing member to block the entry of compressed gas through the input port.

6. A trigger assembly and mechanical pneumatic valve according to claim 1, wherein the plurality of ports are configured for delivery of compressed gas into the valve, out of the valve, and between valve components, and wherein:

the input port is configured to deliver compressed gas from the compressed gas source into a valve chamber;

the first output port is configured to communicate compressed gas between the valve chamber and a pneumatic assembly of the pneumatic gun; and the second output port is configured to release compressed gas from the valve to atmosphere, either directly or through a separate exhaust port.

7. A trigger assembly and mechanical pneumatic valve according to claim 1, wherein the valve actuator is permitted to travel an additional distance beyond an initial point where the pin valve opens, such that the firing operation occurs at an intermediate time during the trigger pull to improve accuracy and feel during the firing operation.

8. A trigger assembly and mechanical pneumatic valve according to claim 1, wherein the actuator further includes a return mechanism to urge the actuator from the firing position back to a ready position when the trigger is released.

9. A trigger assembly and mechanical pneumatic valve according to claim 1, wherein the pin valve member comprises two reduced diameter sections, wherein a first reduced diameter section is configured to release compressed gas through the second output port past the second sealing member, and wherein a second reduced diameter section is configured to release compressed gas through an exhaust port past a third sealing member, when the valve is in an actuated position.

10. A trigger assembly and mechanical pneumatic valve according to claim 1, wherein the valve further comprises a chamber insert arranged within the valve chamber to hold the first sealing member in place within the input port.

* * * * *